United States Patent [19]

Yoshinari et al.

[11] Patent Number: 4,522,801

[45] Date of Patent: Jun. 11, 1985

[54] PROCESS FOR PRODUCING CARBON FIBER OR GRAPHITE FIBER

[75] Inventors: Osamu Yoshinari; Yoshifumi Kawakatsu; Hideaki Fukuizumi, all of Shizuoka, Japan

[73] Assignee: Toho Beslon Co., Ltd., Tokyo, Japan

[21] Appl. No.: 540,735

[22] Filed: Oct. 11, 1983

[30] Foreign Application Priority Data

Oct. 8, 1982 [JP] Japan ..... 57-176335

[51] Int. Cl.[3] ..... D01F 9/22

[52] U.S. Cl. ..... 423/447.4; 423/447.6; 264/29.2

[58] Field of Search ..... 423/447.1, 447.2, 447.4, 423/447.6, 447.8, 447.9, 448; 252/502; 264/29.2; 428/367, 408

[56] References Cited

U.S. PATENT DOCUMENTS

| | | | |
|---|---|---|---|
| 3,619,139 | 11/1971 | Dixon et al. | 423/447.1 |
| 3,933,986 | 1/1976 | Matsumura et al. | 423/447.4 |
| 4,069,297 | 1/1978 | Saito et al. | 423/447.4 |
| 4,259,307 | 3/1981 | Maruyama | 423/447.4 |

*Primary Examiner*—Earl C. Thomas
*Assistant Examiner*—Jeffrey E. Russel
*Attorney, Agent, or Firm*—Sughrue, Mion, Zinn, Macpeak, and Seas

[57] ABSTRACT

High-performance carbon fiber or graphite fiber can be produced by treating the preoxidized fiber or carbon fiber strand with an aqueous solution containing at least one member of polyethylene oxide having a molecular weight greater than 100,000, methyl cellulose, ethyl cellulose, and hydroxyethyl cellulose, and drying the treated fiber strand at a temperature lower than 250° C. prior to carbonization or graphitization.

28 Claims, No Drawings

PROCESS FOR PRODUCING CARBON FIBER OR GRAPHITE FIBER

FIELD OF THE INVENTION

The present invention relates to a process for producing high-performance acrylic carbon fiber or graphite fiber.

BACKGROUND OF THE INVENTION

Usually, acrylic carbon fiber or graphite fiber is produced by heating acrylonitrile fiber strands in an oxidative atmosphere to produce preoxidized fiber, carbonizing the preoxidized fiber in an inert atmosphere to produce carbon fiber, and finally graphitizing the carbon fiber at a high temperature to produce graphite fiber (as disclosed in, for example, U.S. Pat. Nos. 4,069,297 and 4,197,279).

This process, however, involves several technical problems in the case of continuous operation. That is to say, in the step of carbonization or graphitization, fluff and waste fiber accumulate in the oven to narrow the yarn guides and roller guides. This causes the fiber strand passing through them to fluff. In the step for producing preoxidized fiber from acrylonitrile fiber, a certain degree of coalescence of fibers (sticking of fiber to fiber) is inevitable. Excessive coalescence results in carbon fiber of low strength. In the process for heat treatment of preoxidized fiber, the fiber passes over many rollers and roller guides. They inevitably cause some damage to the surface of the fiber. This surface damage decreases the strength of the carbon fiber. The same applies to the process of graphitization.

SUMMARY OF THE INVENTION

It is an object of this invention to provide a process for producing high-performance carbon fiber or graphite fiber which causes a minimum of fluffing and coalescence.

The process of this invention is an improved process for producing carbon fiber or graphite fiber by continuously feeding a preoxidized fiber strand into a carbonizing oven or a carbon fiber strand to a graphitizing oven for heat treatment, wherein said improvement comprises treating the fiber strand to be heat treated with an aqueous solution containing at least one member of polyethylene oxide having a molecular weight greater than 100,000, methyl cellulose, ethyl cellulose, and hydroxyethyl cellulose, and drying the treated fiber strand at a temperature lower than 250° C. prior to said heat treatment.

DETAILED DESCRIPTION OF THE INVENTION

According to the process of this invention, it is possible to considerably reduce the accumulation in the carbonizing oven or graphitizing oven, and to obtain carbon fiber or graphite fiber having a minimum of fluff. Moreover, it is possible to separate the preoxidized fiber which has coalesced together and to prevent the surface damage of the fiber. These lead to high-strength carbon fiber or graphite fiber.

Furthermore, according to the process of this invention, it is possible to reduce fluff and waste fiber that accumulate in the carbonizing oven or graphitizing oven to narrow the yarn guides, and it is possible to prevent the fiber strand from fluffing and being caught by the guide rollers which they pass over before the oven. It is possible to separate the fiber which has coalesced together in the preoxidation step. It is also possible to protect the preoxidized fiber and carbon fiber from surface damage when they pass over the roller guides. Thus it is possible to produce high-performance carbon fiber or graphite fiber.

The preoxidized fiber strand to be treated is obtained from an acrylonitrile fiber strand made of a polyacrylonitrile or a copolymer preferably composed of a vinyl compound and more than 90 wt.% of acrylonitrile. Generally, the fiber strand is made up of 100 to 30,000 filaments, and each filament has a fineness of 0.5 to 1.5 denier.

The acrylonitrile fiber strands are treated in an oxidative atmosphere, e.g., air, at 220° to 300° C. to produce preoxidized strands. The treatment is preferably performed to such an extent that the quantity of bonded oxygen in the fiber reaches 6 to 15%.

The chemial substance (referred to as "sizing agent" hereinafter) with which the preoxidized fiber or carbon fiber is treated is polyethylene oxide (PEO) having a molecular weight greater than 100,000, preferably 100,000 to 4,800,000, and more preferably 600,000 to 1,100,000. Polyethylene oxide having a molecular weight lower than 100,000 are low in viscosity and do not effectively prevent the fluffing. Those having a molecular weight greater than 1,100,000 provides a treating aqueous solution having an excessively high viscosity even at a low concentration. In such a case and in the case of a treating solution having a high concentration and an excessively high viscosity, the viscosity can be reduced by adding a water-miscible low-boiling organic solvent such as acetone, methanol, and ethanol.

Other sizing agents are methyl cellulose, ethyl cellulose, and hydroxyethyl cellulose, preferably having a degree of substitution of 1.6 to 2.0%, 0.7 to 1.3%, and 1.4 to 1.5%, respectively. The above-mentioned sizing agents may be used individually or in combination with one another.

The sizing agent is generally used in the form of 1 g/l to 20 g/l solution. The solvent is water or a mixture of water and a water-miscible low-boiling organic solvent as described above such as acetone, methanol, and ethanol. The mixed solvent is advantageous when the solution viscosity is excessively high when water is used alone. Reducing the viscosity is desirable to load a large amount of sizing agent using a solution having a high concentration. An excessively viscous solution causes the strands to stick to one another and also causes fluffing after drying. For use, a mixed solvent containing 40 to 80% of organic solvent is preferable.

The temperature at which the fiber strand is treated with the sizing agent is not specifically limited; but it is usually 15°-30° C., and preferably 20°-25° C.

The loading of the sizing agent to preoxidized fiber strand is preferably 0.01 to 0.5 wt% (based on the weight of the untreated fiber), and more preferably 0.1 to 0.3 wt%. If the loading is less than 0.01 wt%, the effect of preventing fluffing is not produced sufficiently; and if the loading is in excess of 0.5 wt%, sticking of strands (sticking of a strand to the other strand) and coalescence of carbonized fiber take place.

The loading of the sizing agent to carbon fiber strand is preferably 0.1 to 5 wt%, and more preferably 0.5 to 2 wt%. If the loading is less than 0.1 wt%, the effect of preventing fluffing is not produced sufficiently; and if the loading is in excess of 5 wt%, sticking of strands takes place, and it causes fluffing.

For treatment, the fiber strand is passed through or sprayed with the aqueous solution of sizing agent. Other methods such as roller coating can also be used. The coalescence of preoxidized fiber can be removed after treating the preoxidized fiber with an aqueous solution of the sizing agent by applying a proper mechanical force to the fiber so that coalesced fibers are separated. The treated fiber strand is usually passed through squeeze rollers or passed over a round object under pressure. This is effective to separate coalesced fibers. In order to prevent the treated fiber strand from sticking together, the treated fiber strand is preferably squeezed so that the water content is reduced to about less than 45 wt% by dry base (based on the total weight of the dry fiber and the sizing agent).

The treated fiber strand is then dried at a temperature not higher than 250° C., preferably 120° to 170° C. If the treated fiber strand is introduced into the carbonizing oven or graphitizing oven without drying, the resulting carbon fiber or graphite fiber is low in strength. On the other hand, if the drying is accomplished at a temperature higher than 250° C., the fiber strand will coalesce together and the resulting carbon fiber or graphite fiber provides poor performance. The drying is preferably performed to such an extent that the water content of the strand reaches not more than 5 wt% by dry base, preoxidized fiber, and preferably not more than 1 wt%, and more preferably not more than 0.1 wt% in the case of carbon fiber.

The treatment with the sizing agent and the drying thereafter should be carried out on a fiber strand. Treatment of fiber in the form of doubling strand or when the same is wound on a reel or bobbin will cause sticking of strands.

The preoxidized fiber which has been treated with the sizing agent is carbonized generally at 800° to 1500° C. for 1 to 5 minutes in an inert atmosphere such as nitrogen, argon and mixture thereof. It is graphitized when further heated at 1500° to 3000° C. in an inert atmosphere as described above. The carbon fiber obtained as mentioned above may be treated again with the sizing agent of this invention before it is graphitized. The graphite fiber thus obtained is improved in quality. The sizing agent of this invention may also be applied to the carbon fiber obtained in the other method, in order to produce the graphite fiber of improved quality.

Furthermore, the preoxidized fiber or carbon fiber treated with the sizing agent of this invention may be carbonized or graphitized after fabrication into nonwoven fabric, woven fabric, felt, etc.

Tables 1 and 2 show the effect of the loading amount of the sizing agent and the effect of the drying temperature on the quality of the resulting carbon fiber and graphite fiber.

TABLE 1

| | Carbon fiber | | | | |
|---|---|---|---|---|---|
| Loading on preoxidized fiber (wt %) | Number of fluffs (per m) | Number of coalescence | Strength (kg/mm$^2$) | Modulus of elasticity (kg/mm$^2$) | Elongation (%) |
| 0.005* | 103 | 26 | 400 | 24,300 | 1.65 |
| 0.01 | 62 | 10 | 430 | 24,200 | 1.8 |
| 0.1 | 37 | 2 | 440 | 24,000 | 1.8 |
| 0.3 | 39 | 4 | 440 | 23,900 | 1.8 |
| 0.5 | 41 | 7 | 430 | 24,200 | 1.8 |
| 1.0* | 114 | 34 | 390 | 23,900 | 1.63 |
| | Graphite fiber | | | | |
| Loading on carbon fiber (wt %) | Number of fluffs (per m) | Number of coalescence | Strength (kg/mm$^2$) | Modulus of elasticity (kg/mm$^2$) | Elongation (%) |
| 0.05* | 70 | 1 | 260 | 36,800 | 0.71 |
| 0.5 | 56 | 3 | 305 | 36,100 | 0.97 |
| 2.0 | 50 | 5 | 310 | 36,400 | 0.85 |
| 5.0 | 58 | 4 | 280 | 36,100 | 0.78 |
| 7.0* | 85 | 3 | 275 | 35,800 | 0.77 |

Note:
Sizing agent: Polyethylene oxide having a molecular weight of 600,000 to 1,100,000.
Drying temperature: 130° C.
*Outside the range of the preferable amount of the sizing agent.

and more preferably not more than 1 wt% in the case of

TABLE 2

| | Carbon fiber | | | |
|---|---|---|---|---|
| Drying temperature for preoxidized fiber (°C.) | Number of coalescence | Strength (kg/mm$^2$) | Modulus of elasticity (kg/mm$^2$) | Elongation (%) |
| No dried* | 147 | 255 | 24,300 | 1.05 |
| 130 | 2 | 440 | 24,500 | 1.80 |
| 300* | 186 | 287 | 24,000 | 1.20 |
| | Graphite fiber | | | |
| Drying temperature for carbon fiber (°C.) | Number of coalescence | Strength (kg/mm$^2$) | Modulus of elasticity (kg/mm$^2$) | Elongation (%) |
| No dried* | 80 | 240 | 36,500 | 0.66 |
| 130 | 4 | 308 | 36,400 | 0.85 |

TABLE 2-continued

| | | | | |
|---|---|---|---|---|
| 300* | 206 | 220 | 35,800 | 0.61 |

Note:
Sizing agent: Polyethylene oxide having a molecular weight of 600,000 to 1,100,000.
Loading of sizing agent:
0.1 wt % for preoxidized fiber
1.0 wt % for carbon fiber
*Outside the scope of this invention.

The invention is described with reference to the following examples and comparative examples.

EXAMPLE 1

Ten strands (each strand coprises 6000 filaments) of acrylonitrile fiber (each filament has 0.9 denier) were preoxidized at 250° C. for 60 minutes in air to produce preoxidized fiber strands (containing 12% of bonded oxygen). The preoxidized fiber strands were dipped in an aqueous solution (about 20° C.) containing 2 g of the sizing agents as shown in Table 3 in 1 liter of water. After squeezing with pressure rubber rollers so that the water content was 40% (by dry base), the treated fiber strands were dried at 130° C. until the water content decreased to 4 to 5 wt%. The fiber strands were carbonized at 1400° C. for 1 minute in a carbonizing oven. The resulting carbon fiber was subjected to the electrolytic oxidation with 10% NaOH aqueous solution. The carbon fiber was then washed with water, dried (at 170° C.), and coated with epoxy resin (1.6 wt%). The quantity of fluff which had accumulated on the guide at the exit of the dryer was determined. Number of fluffs, number of coalescence, strength, modulus of elasticity, and elongation were measured for the wound product. The results are shown in Table 3.

The number of fluffs and the number of coalescence were determined as follows:

(Number of fluffs)

A 6000-filament strand is dipped in acetone to remove the sizing agent. The strand is stretched over a span of about 1.5 meters, and acetone is removed by air drying. Then air is blown to open the strand. The number of fluffs on a length of 1 meter is counted.

(Number of coalescence)

A 6000-filament strand is cut to 3 mm, and the cut strand is ultrasonically washed in acetone to remove the sizing agent. The number of coalesced fibers is counted under a microscope of 6.3 magnifications.

TABLE 3

| | Example 1 | | | Comparative Example | |
|---|---|---|---|---|---|
| | Sizing Agent | | | | |
| | PEO (A) | MC | HEC | Control | PEO (B) |
| Loading (wt %) | 0.08 | 0.08 | 0.08 | 0 | 0.08 |
| Accumulation on guides in dryer (g/120 minutes) | 0.03 | 0.04 | 0.03 | 0.1 | 0.08 |
| Number of fluffs on product (per m) | 40 | 51 | 46 | 103 | 75 |
| Number of coalescence | 3 | 5 | 5 | 20 | 13 |
| Strength (kg/mm$^2$) | 450 | 440 | 440 | 400 | 400 |
| Modulus of elasticity (kg/mm$^2$) | 24000 | 24500 | 24500 | 24000 | 24000 |

TABLE 3-continued

| | Example 1 | | | Comparative Example | |
|---|---|---|---|---|---|
| | Sizing Agent | | | | |
| | PEO (A) | MC | HEC | Control | PEO (B) |
| Elongation (%) | 1.9 | 1.8 | 1.8 | 1.68 | 1.7 |

Note:
PEO (A): Polyethylene oxide having a molecular weight of 60,000 to 1,100,000.
PEO (B): Polyethylene oxide having a molecular weight of 50,000.
MC: Methyl cellulose (degree of substitution: 1.6 to 2.0%)
MHC: Hydroxyethyl cellulose (degree of substitution: 1.4 to 1.5%)

EXAMPLE 2

Carbon fiber was produced in the same manner as in Example 1, except that an aqueous solution (2 g/liter, at 20° C.) of methyl cellulose (degree of substitution: 1.6 to 2.0%) was used as the sizing agent, and the drying was carried out under the conditions shown in Table 4. The number of fluffs etc. measured for the product are shown in Table 4.

TABLE 4

| | Example 2 | Comparative Example | |
|---|---|---|---|
| Drying temperature before carbonization | 130° C. | 300° C. | Not dried |
| Water content (wt %) | 4–5 | 4–5 | |
| Number of fluffs on product (per m) | 48 | Countless | Countless |
| Number of coalescence | 5 | 200 | 150 |
| Strength (kg/mm$^2$) | 440 | 273 | 250 |
| Modulus of elasticity (kg/mm$^2$) | 24500 | 24400 | 24100 |
| Elongation (%) | 1.8 | 1.1 | 1.0 |

Note: Loading: 0.08 wt %

EXAMPLE 3

6000-Filament carbon fiber strands were treated with different kinds of sizing agents dissolved in a mixed solvent of acetone and water (70/30 by volume) at a concentration of 7 g/liter at 20° C. as shown in Table 5. The treated fiber strands were squeezed by rollers so that the water content was 49% (or the content of the mixed solvent was 140%), and then dried at 120° to 130° C. until the water content reached 0.01 wt%. The carbon fiber was finally graphitized at 2400° C. for 60 seconds in a nitrogen atmosphere by using a graphitizing oven.

The resulting graphite fiber was treated, washed, and dried as in Example 1, and coated with an epoxy resin at a loading of 1.4 wt%. The finished graphite fiber was wound up. The number of fluffs etc. were measured for the wound graphite fiber. The results are shown in Table 5.

TABLE 5

| | Example 3 | | Comparative Example | |
|---|---|---|---|---|
| | Sizing Agent | | | |
| | Polyethylene oxide* | Methyl cellulose | Bisphenol A epoxy resin (7 g/l acetone solution) | Control |
| Loading (wt %) | 1 | 1 | 1 | 0 |
| Number of fluffs on product (per m) | 51 | 43 | 168 | 205 |
| Strength (kg/mm$^2$) | 317 | 304 | 251 | 282 |
| Modulus of elasticity (kg/mm$^2$) | 36800 | 36700 | 36000 | 36400 |
| Elongation (%) | 0.86 | 0.83 | 0.70 | 0.77 |

*Molecular weight: 600,000 to 1,100,000

While the invention has been described in detail and with reference to specific embodiments thereof, it will be apparent to one skilled in the art that various changes and modifications can be made therein without departing from the spirit and scope thereof.

What is claimed is:

1. A process for producing acrylic carbon fiber with minimized fluffing and coalescence, comprising:

treating a preoxidized fiber strand derived from an acrylonitrile fiber strand with an aqueous solution containing a compound selected from the group consisting of polyethylene oxide having a molecular weight greater than 100,000, methyl cellulose, ethyl cellulose, and hydroxyethyl cellulose;

drying the treated fiber strand at a temperature lower than 250° C.; and continuously feeding the dried treated fiber strand into a carbonizing oven, wherein said acrylonitrile fiber comprises a polyacrylonitrile or a copolymer of a vinyl compound and more than 90 wt.% of acrylontrile.

2. A process for producing acrylic graphite fiber with minimized fluffing and coalescence, comprising:

treating a carbon fiber strand derived from an acrylonitrile fiber strand with an aqueous solution containing a compound selected from the group consisting of polyethylene oxide having a molecular weight greater than 100,000, methyl cellulose, ethyl cellulose, and hydroxyethyl cellulose;

drying the treated fiber strand at a temperature lower than 250° C.; and heat treating the dried treated fiber strand by continuously feeding the fiber into a graphitizing oven, wherein said acrylonitrile fiber comprises a polyacrylonitrile or a copolymer of a vinyl compound and more than 90 wt.% of acrylonitrile.

3. A process as claimed in claim 1, wherein the aqueous solution which is water-miscible contains an organic solvent.

4. A process as claimed in claim 3, wherein the organic solvent is selected from the group consisting of acetone, methanol and ethanol.

5. A process as claimed in claim 1, wherein the methyl cellulose, ethyl cellulose, or hydroxyethyl cellulose has a degree of substitution of 1.6 to 2.0%, 0.7 to 1.3%, and 1.4 to 1.5%, respectively.

6. A process as claimed in claim 1, wherein the aqueous solution contains 1 to 20 grams of a sizing agent per liter of solution.

7. A process as claimed in claim 1, wherein the sizing agent is present in an amount of 0.01 to 0.5 wt% based on the weight of the untreated fiber strand.

8. A process as claimed in claim 2, wherein the sizing agent is present in an amount of 0.1 to 5 wt% based on the weight of the untreated fiber strand.

9. A process as claimed in claim 1, further comprising:

applying mechanical force to the treated fiber strand in order to separate the coalescence of fibers.

10. A process as claimed in claim 9, wherein the mechanical force involves passing the treated fiber strand through squeeze rollers.

11. A process as claimed in claim 9, wherein the mechanical force involves pressing the treated fiber strand against a round object under pressure.

12. A process as claimed in claim 1, wherein the treated fiber strand is dried until the water content is not more than 5 wt% based on the total dry weight.

13. A process as claimed in claim 2, wherein the treated fiber strand is dried until the water content of the fiber strand is not more than 0.1 wt% based on the total dry weight.

14. A process as claimed in claim 1, wherein the heat treatment of the fiber strand is carried out at a temperature in the range of 800° to 1,700° C. in an inert gas atmosphere.

15. A process as claimed in claim 2, wherein the heat treatment of the fiber strand is carried out at a temperature in the range of 1,500° to 3,000° C. in an inert gas atmosphere.

16. A process as claimed in claim 1, wherein the polyethylene oxide has a molecular weight of not more than 4,800,000.

17. A process as claimed in claim 2, wherein the polyethylene oxide has a molecular weight of not more than 4,800,000.

18. The process as claimed in claim 1 wherein the fiber strand comprises from 100 to 30,000 filaments having a denier of 0.5–1.5.

19. The process as claimed in claim 2 wherein the fiber strand comprises from 100 to 30,000 filaments having a denier of 0.5–1.5.

20. A process as claimed in claim 1 wherein preoxidation is in an oxidizing atmoshere at 220°–300° C.

21. A process as claimed in claim 2 wherein preoxidation is in an oxidizing atmosphere at 220°–300° C.

22. A process as claimed in claim 1 wherein the compound is polyethylene oxide having a molecular weight of from 600,000 to 1,100,000.

23. A process as claimed in claim 2 wherein the compound is polyethylene oxide having a molecular weight of from 600,000 to 1,100,000.

24. A process as claimed in claim 1 wherein the treating is at a temperature of 15°–30° C.

25. A process as claimed in claim 2 wherein the treating is at a temperature of 15°–30° C.

26. A process as claimed in claim 1 wherein the drying is at a temperature of 120°–170° C.

27. A process as claimed in claim 2 wherein the drying is at a temperature of 120°–170° C.

28. A process as claimed in claim 10 wherein the passing is before drying.

* * * * *